United States Patent [19]

LaFountaine

[11] 4,106,246

[45] Aug. 15, 1978

[54] SWIMMING POOL CONSTRUCTION

[76] Inventor: Leonard Howard LaFountaine, Rte. No. 1 Box 348, Curtice, Ohio 43412

[21] Appl. No.: 815,695

[22] Filed: Jul. 14, 1977

[51] Int. Cl.[2] ..... E04H 3/16

[52] U.S. Cl. ..... 52/169.7; 4/172.19

[58] Field of Search ..... 52/169.7, 309.1, 309.13; 4/172.19

[56] References Cited

U.S. PATENT DOCUMENTS

| | | | |
|---|---|---|---|
| 3,396,500 | 8/1968 | Lankheet | 52/169.7 |
| 3,745,727 | 7/1973 | Chichester | 52/169.7 |
| 4,044,514 | 8/1977 | Rubin et al. | 52/169.7 |

*Primary Examiner*—J. Karl Bell

*Attorney, Agent, or Firm*—Paul F. Stutz

[57] ABSTRACT

A swimming pool construction of the below ground type includes a peripheral side and bottom wall structure composed of a plurality of generally rectangular planar members in edge-to-edge abutment and having inner and outer surfaces bearing an attached sheath, skin or layer of continuous unbroken character and composed of woven fiber glass cloth impregnated with a suitable resin such as a polyester resin and said inner and outer layers having their upper and lower marginal edges in overlapped relationship to completely encapsulate said planar core and said wall further including a continuous upper edge and lower edge stiffener serving together and with said planar wall core to lend unique integral strength.

12 Claims, 5 Drawing Figures

SWIMMING POOL CONSTRUCTION

The present invention relates to a swimming pool construction and more particularly of the type installed on the premises of the residence occupied by a family, usually in the yard or in an adjoining lot.

Home or private pools have significantly increased in numbers over the last ten or so years. These family pools generally fall into two major categories; above ground or below ground pools. The above ground pools, which include partially above ground pools, feature most generally a cumbersome, reinforced, peripheral, upstanding wall engineered and designed to resist the substantial outward lateral forces due to the volume and weight of water contained therein. The walls and the ground or, in some cases, a minor excavation serve as a restraint for a flexible liner, usually formed of vinyl or some such flexible rubber-like material, which can be continuous or separate pieces sewn or adhered together to create a hopefully watertight envelope serving to contain the appropriate amount of water and thus creating the pool of the desired depth or height. While a number of these pools have proven acceptable, problems are encountered in leakage due to failure or development of holes or leaks in the plastic liner or envelope. Additionally, wall failure is encountered, with consequent adverse results. Above ground pools are also frequently undesirable because of their size, creating a profile and bulk size disharmony with the surroundings, be it a particular house, the neighborhood or the like.

Some swimming pools are of the prefabricated variety for above ground installation; see U.S. Pat. No. 3,276,043 and U.S. Pat. No. 3,256,532. The complicated wall structures associated with some of the swimming pool structures referred to above are illustrated in U.S. Pat. No. 3,192,538. The use of cement asbestos panels as a support for a vinyl liner is illustrated in U.S. Pat. No. 3,020,560. Vinyl liners are also used in the pool structure disclosed in U.S. Pat. No. 3,317,927. An alternative vinyl liner is disclosed in U.S. Pat. No. 3,675,253; the latter structure requiring a multitude of angular braces anchored in concrete, serving as a detriment and disadvantageous feature of the latter structure.

Below ground pools have generally featured, of course, an excavation and some sort of lining to hold the water. One such liner is simply an envelope formed of vinyl or similar rubber-like material with the earth itself; that is, the vertical surface of the excavation providing the backup. This is objectionable because the earth shifts and the wall crumbles inwardly, leading to ultimate destruction. Other types of liners include poured concrete, laid up concrete block or a gun-applied, cement-like product on the side walls of the excavation or plied around the side walls of the excavation to define a uniform wall; following which, a flexible liner, usually vinyl, is employed to provide the watertight character. A totally cement pool avoids the frequently undesirable vinyl liner which is troublesome because of the development of leaks, many of which are of only pin hole size and therefore difficult to locate and requiring almost constant repair by the use of patches and adhesives. A particular disadvantage of the vinyl liner resides in almost unavoidable relative movement between the vinyl liner and the supporting wall or in the upper edge region of the pool which must withstand a considerable amount of traffic. The relative movement creates friction and, of course, increases the chances of leakage and, of course, ultimately deterioration and destruction of the vinyl liner at the points or regions of movement and/or high traffic as proximate the exit ladder or the continuous peripheral upper edge where users enter or leave the pool. Concrete pools, of course, are almost prohibitively expensive and furthermore are not without their drawbacks, particularly in the latitudes accompanied by development of a frost level to a significant depth which can from time to time cause buckling or cracking of the concrete, with attendant necessary expensive repairs or even replacement. The concrete pool is quite expensive by reason of the material and also by reason of the considerable amount of labor necessary in constructing to lay the cement or lay up the concrete block. Wood, while possessed of strength, is short lived below ground due to developed rot and disintegration.

With the foregoing introduction, it may be stated that a principal object of the present invention is to provide a pool construction which is significantly avoidative of the above-enumerated disadvantages of pool structures which are presently commercially available and which have been generally described hereinabove.

It is a particular object of the present invention to provide a pool structure of the below ground level type which avoids the use of expensive concrete and the employment of the leak prone vinyl liner.

It is yet another object of the present invention to provide a below ground pool structure featuring a low cost rigid wall which is capable of a degree of yielding as opposed to the complete rigidity of concrete such that lower temperatures and penetration of frost into the ground with attendant movement will not cause cracks, as in the case of cement or concrete block pools.

It is still another object of the present invention to provide a pool structure featuring an essentially continuous inner surface which is integral with the strengthening wall and which inner surface is watertight and resistant to cracking, friction and/or the development of pin holes and therefore retains its leak-proof character.

It is yet another object of the present invention to provide a pool structure in which the slightly yieldable nature is provided by an essentially segmented wall core or a core formed of independent and separate members, while the surface, skin or sheath is continuous but completely and essentially permanently bonded to the inner segmented core.

It is still another object of the present invention to provide a pool structure featuring an upper edge inclusive of integral means for permanently anchoring into the surrounding concrete apron in the upper regions of the surrounding ground or earth.

It is also an object of the present invention to provide a pool structure featuring a wall having upper and lower edge stiffener arrangements which are continuous, with the latter providing a supporting ledge or lip for mating engagement with the bottom wall in leak-resistant fashion.

The foregoing as well as other objects of the present invention will become apparent to those skilled in the art from the following detailed description taken in conjunction with the annexed sheets of drawings on which there is presented, for purpose of illustration only, a single embodiment of the present invention.

IN THE DRAWINGS

Figure 1:
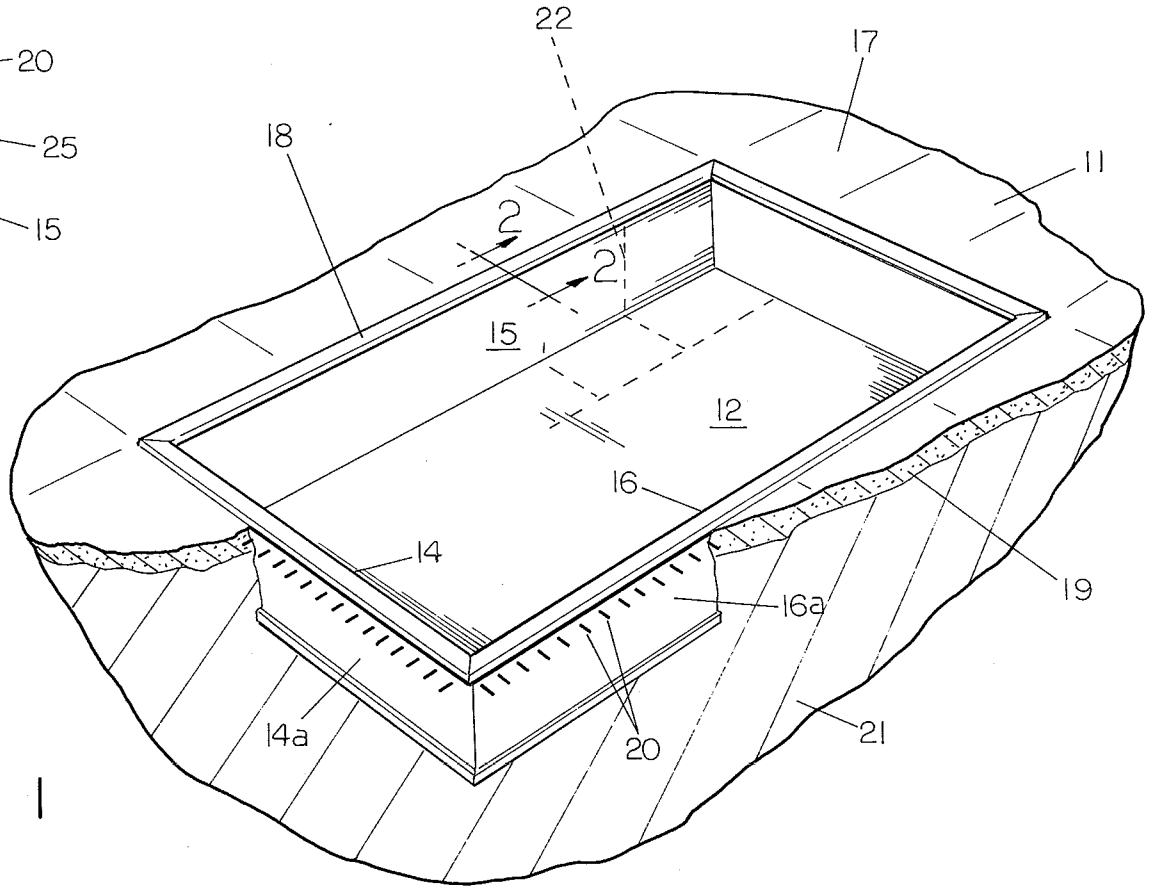
FIG. 1 is a three-quarter perspective view of a pool embodying the wall structure of the present invention and with a portion of the surrounding earth broken away to show the wall and a corner structure in more detail.
Figure 2:
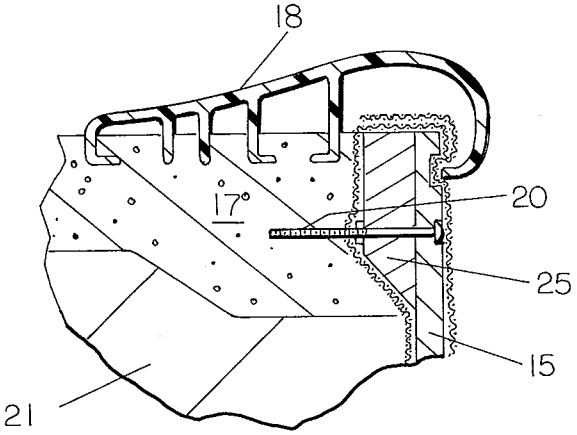
FIG. 2 is a sectional view taken on the line 2—2 of FIG. 1.

Referring now more specifically to the drawings, there is disclosed in FIG. 1 the below ground pool generally identified by the reference numeral 11. The pool is composed of a bottom wall 12, spaced parallel end walls 13 and 14 and spaced parallel side walls 15 and 16. The pool is surrounded by a concrete apron 17 on a horizontal upper surface which terminates proximate the wall. The apron 17 surrounds the excavation in the earth identified by the reference numeral 21 to a depth of about 3 inches and extending laterally away from the side walls a distance of several feet. The walls are each covered by a sill, combing, or a cap 18 which is situated on top of the side and end walls and anchored in the apron, as will be described more fully hereinafter. In this FIG. 1, the concrete apron and earth have been cut away on the line 19 to show the ground-contacting surface 16*a* of side wall 16 and ground-contacting surface 14*a* of end wall 14. Each of these walls has projecting horizontal therefrom a plurality of anchor bolts 20 which can be seen by reason of the breakaway, but those not seen are firmly anchored in the concrete 17. The sill or combing 18 is likewise embedded in the concrete apron. The side walls and end walls are each composed of a plurality of 8 ft. by 4 ft. plywood panels measuring $\frac{3}{4}$ inch in thickness, with the dotted lines, see reference numeral 22, identifying the edges of the 8 × 4 panels which are in edge-to-edge abutment with the next adjoining panel in the same wall and the panels in a given wall being secured together by edge stiffeners and a surrounding sheath, skin or encapsulating layer in a manner to be more fully described hereinafter.

Figure 3:
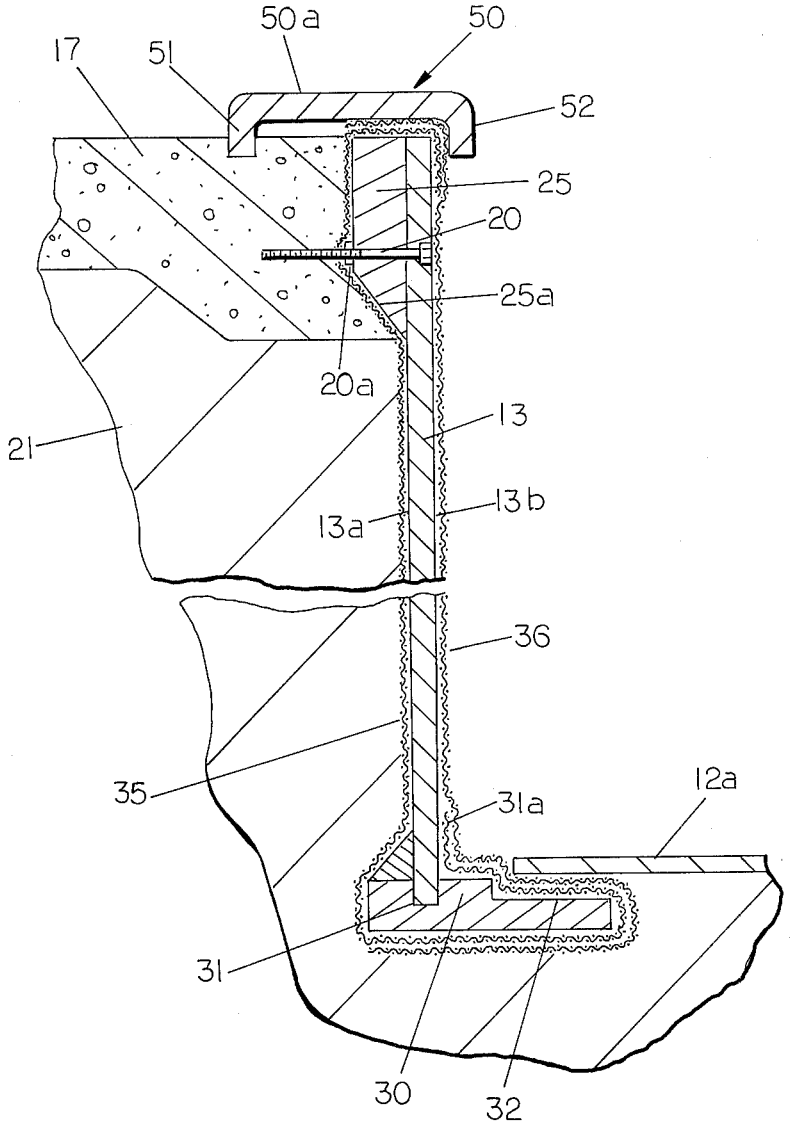
FIG. 3 is a sectional view of a wall of a swimming pool; said wall embodying features of structure in accordance with preferred embodiments of the present invention.

FIG. 3 is a vertical sectional view of a side or end wall of the pool in accordance with a principal embodiment of the present invention and serves to illustrate the nature of the structure of the wall and its associated components. The wall identified by the reference numeral 13 is a piece of 8 × 4 × $\frac{3}{4}$ inch plywood having an inner surface 13*b* and an outer ground-contacting surface 13*a*. The outer surface 13*a* has secured thereto along its upper edge, as by nailing or adhesive, a stiffener member 25 formed of a continuous length of 2 × 6, with one lower edge beveled as at 25*a*. A bottom edge stiffener 30 formed of a length of 2 × 8 corresponding to the dimension of the particular end or side wall has an upwardly facing groove 31 of a thickness snugly receptive of the thickness of the plywood panel of which the side wall 13 is formed and a corner cutaway as at 32 of a sufficient depth or height to just receive the $\frac{1}{2}$ inch thickness of the 4 × 8 forming the bottom wall; the latter identified as reference numeral 12*a*. The cutaway 32 is sized to snugly and flushly receive the bottom wall and by reason thereof and other constructional features, particularly the skin or sheath and the finishing procedure, provides a watertight and/or leak-proof seam at the joinder of the side wall and the bottom wall.

A plurality of anchor bolts 20 measuring $\frac{3}{8}$ inch diameter by 10 inches long are inserted through predrilled holes in the wall and the upper edge stiffener 25 to project into the concrete apron 17 which is poured after the side and bottom walls are situated in the excavation. The bolts proceed from the inner surface 13*b* and are secured by a suitable nut 20*a*. Preferably, the heads of the bolts are recessed as shown.

The outer surfaces 13*a* of the side-by-side array of plywood panels forming the wall 13 are covered by a singular layer, skin or sheath of 10 ounce woven fiber glass cloth 35 impregnated with a polyester resin which also secures the cloth to the wall surface. The fiber glass cloth is a continuous length coextensive at least with the length of the end or side wall and is of sufficient width to extend about the top edge and also about the bottom edge stiffener 30 and reversely upwardly as at 31*a*. The inner surfaces 13*b* of the abutting 8 × 4 panels making up the extent of the wall 13 are covered by a continuous length of polyester resin impregnated 10 ounce woven fiber glass cloth 36; the resin similarly serving to bondingly secure the cloth to the wall surface and the overlap. The length, as indicated, is continuous from one end of the wall to the other and is of sufficient width to overlap with the upper and lower edges of the fiber glass cloth 35 on the outer or ground side of the wall 13. A sill, combing or cap member 50 covers the top edge of the side wall composed of the top edge of the wall 13 and the flushly abutting top stiffener 25. The cap 50 includes a horizontal segment 50*a* which extends the full length of the wall and depending parallel legs 51 and 52 which likewise extend the full length of the wall. The depending leg 51 is embedded in the concrete while still soft or deformable, with the spaced opposite leg 52 snug against the upper facing surface of the wall.

Figure 5:
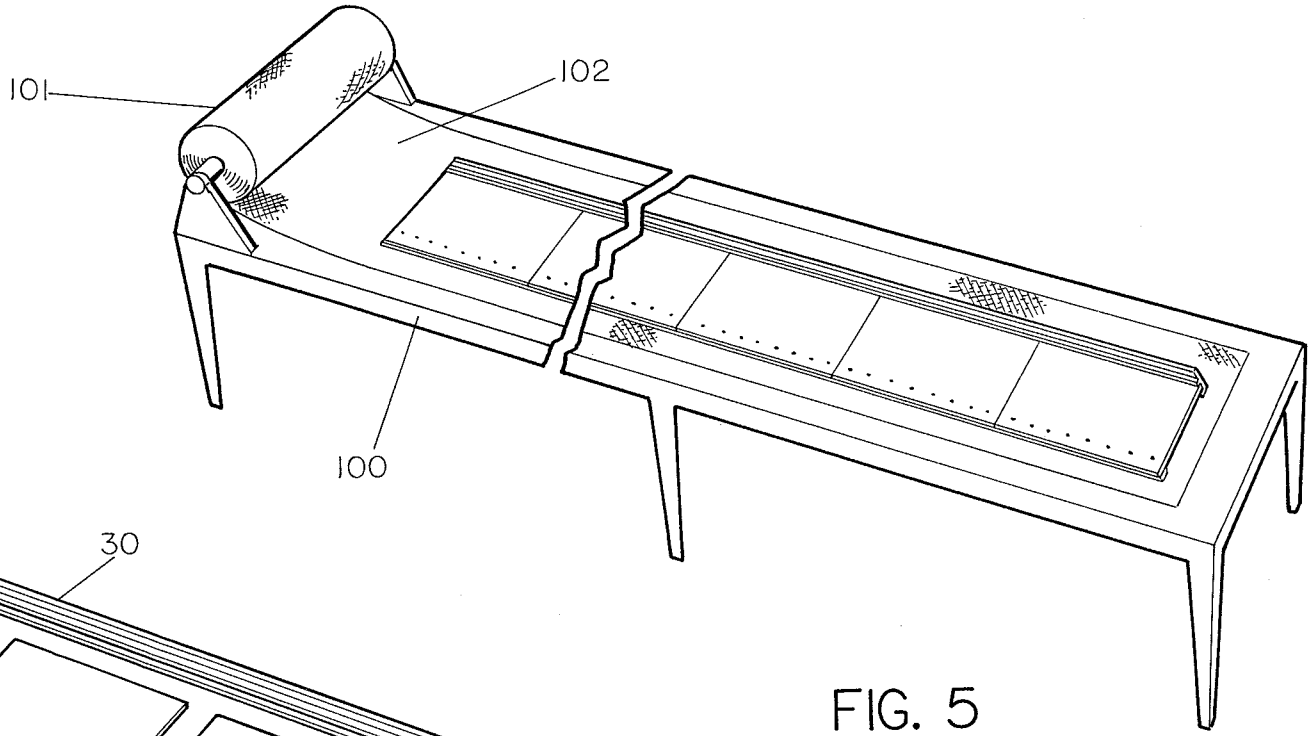
FIG. 5 is a view similar to FIG. 3 but showing a continuous wall segment on a worktable in an intermediate stage of fabrication.
Figure 4:
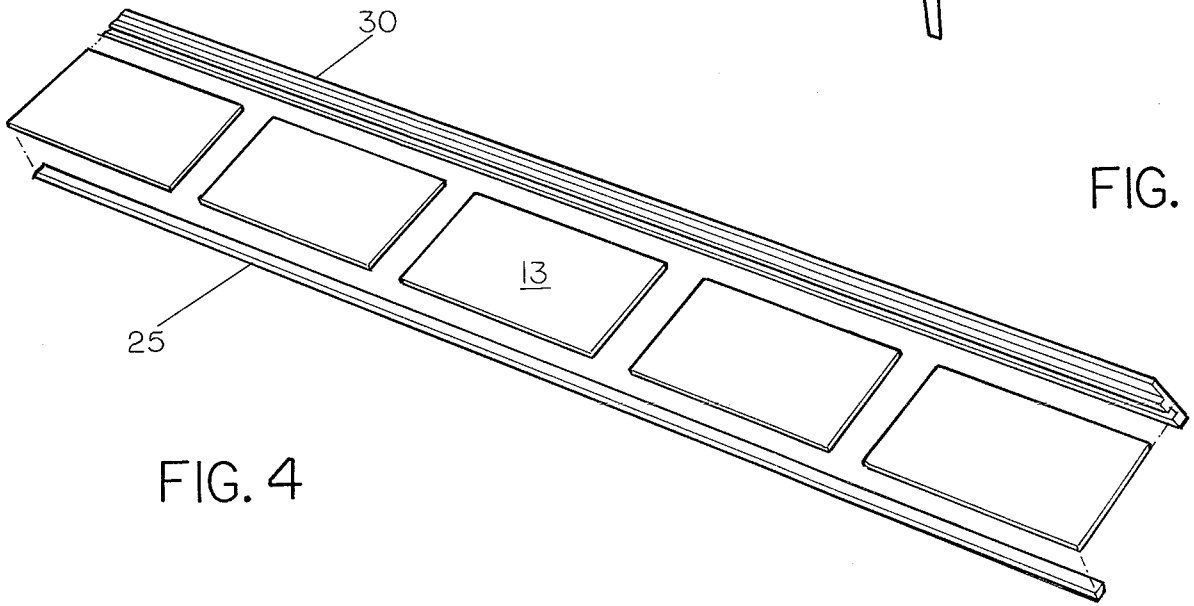
FIG. 4 is a three-quarter perspective schematic view of components making up the wall structure shown in unassembled, but ready to be assembled array in their relative position.

The side, end and bottom walls of the pool construction as described above are preferably preformed or prefabricated by the pool contractor at a suitable central location or manufacturing facility, e.g., factory, rather than at the site of the pool installation. At the factory or manufacturing site, a supply of plywood panels, wood, reels of fiber glass cloth and liquid resin may be inventoried and disposed about for efficient utilization and combining of these latter items in a proscribed desirable manner to yield the desired product. Initially, of course, the plywood panels may need some modification. Usually, the number of 8 × 4 panels necessary to compose the length of wall for the particular pool are laid in edge-to-edge abutment on a sufficiently long worktable. The panels are secured to the worktable by nailing and the horizontal surface is ground as necessary to achieve flatness. Any cracks or depressions are filled with wood, putty or the like, reground and swept clean. Next, the 2 × 6 upper edge stiffener 25 is nailed along the top edges of the edge abutting panels, with the beveled corner facing upward. The arrangement of the panels, stiffeners and the roll of the fiber glass cloth is generally shown in FIGS. 4 and 5. The top edge stiffener member 25, when nailed along the top edge, rigidifies and unifies the wall panels in their edge-to-edge abutment. The stabilizer is first preferably coated with a polyester resin to complement and augment the nailing securement of the stiffener along the top edge. Then the resin-coated 2 × 8 bottom edge stiffener is secured to the bottom edges of the 8 × 4 panels with nails and with the bottom edges of the panels located in resin-coated grooves. This stiffener further rigidifies the assembly of panels, yielding what may be described as an I-beam structure, as viewed in section. The anchor bolts are next secured in the wall by first predrilling appropriately sized holes through the upper edge stiffener and wall with an included countersink for the head of the bolt, then inserting the bolts through the holes. A matching threaded nut is applied and tightened severely, followed by a refinishing and refilling of the depressions made by the severe tightening.

With the upper surface prepared and the stiffeners attached, the horizontal upwardly facing surface of the abutting panels is coated liberally with polyester resin. Then a continuous length of the 10 ounce woven fiber glass cloth is pulled from a supply roll and spread over the entire length of the upwardly facing surface of the wall. The roll is selected of a width to be sufficient to extend around the stiffener members and slightly to the underside. Additional polyester resin is liberally applied to the cloth and spread to achieve complete coverage and full impregnation of the cloth and to insure a wetting of the surface of the wood. When the resin has dried, the entire wall is flipped over to put the water-contacting surface **13*b*** in upwardly facing position. The wood surface is ground and filled as needed and thence cleaned. A coat of polyester resin is brushed or rollered over the entire surface, making sure to fully impregnate the overlapped edges from the cloth on the other side. Another layer of 10 ounce woven cloth is then laid down, fully covering the upwardly facing surface of a width sufficient to overlap the edges of the woven glass cloth extending over from the other side. More resin is applied to insure complete saturation or impregnation of the cloth and wetting of the wood surface. When dried, the plywood panels and stiffeners are fully encased or sheathed in fiber glass cloth resin layers which are integrally bonded to the wood surface. The end edges can be trimmed with a knife and overlapped ends of cloth secured with additional resin. This latter step can be coincident with the application of the final resin coat to the glass cloth on this surface so that drying times proceed simultaneously. When the wall is completely dried, it can be moved or manipulated and consequently shipped or trucked to the pool site quite handily despite its cumbersome size and with little fear of breakage. The preceding advantage is due to the polyester resin-impregnated cloth encasement coupled with the bottom and top edge stiffeners all cooperating to provide tremendous strength and integrity but with the ability to undergo some slight flexing without damage or danger of cracking. As previously indicated, the foregoing is seen as analogous to an I-beam effect.

Referring now to FIGS. 4 and 5, the top edge stiffener member is identified by the reference numeral 25, the bottom edge stiffener by the reference numeral 30, with the side-by-side 4 × 8 plywood panels bearing the reference numeral 13 corresponding to the wall 13 in FIG. 3. In FIG. 5, the assembly of wall panels and edge stiffeners are located on a worktable 100 having at one end a supply roll 101 of fiber glass cloth 102 which can be unreeled sufficiently to accommodate the length of the wall segment concerned. The worktable is about waist high and therefore convenient for hand manipulation and assembly of the components into completed integral walls, of which there would be two end walls and two side walls for the conventional pool. Auxiliary wall segments are similarly prepared for pools designed with a deep end for diving and therefore requiring a lower tier of assembled panels into the desired length.

Bottom wall panels are similarly prepared of assemblies of 8 × 4 panels butted end-to-end and encased with layers of fiber glass cloth impregnated with resin. When all of the segments including the end walls and side walls of the pool are completed at the factory, they are transported to the excavation site which corresponds to the size of the pool wall segments and including the minor excavation for the cement apron. To install the pool, the side and end walls are lowered into the excavation and abutted against the surrounding earth. Corner seams between the end and side walls are finished on the job site, with strips of fiber glass cloth saturated with resin and laid up to form the corner seam. Strips are usually 4 to 8 inches wide and of a length corresponding to the height of the wall. The bottom walls, as indicated previously, are located with their peripheral edges nested into the corner recess 32 in the bottom edge stiffener of the side wall as particularly shown in FIG. 3. Widths of fiber glass cloth are saturated with resin and laid along the seams at the mating juncture of that bottom wall edge and the side wall corner, as well as the seams at the juncture of lengths of abutting 8 × 4 panels forming the bottom wall. The drying or curing time can be adjusted by proportioning the resin components in two component mixes or by appropriate level or concentration of the catalyst or hardener component.

With the walls in place, the concrete is poured into surrounding complementarily located forms to a satisfactory level above the anchoring bolts projecting outwardly into the apron excavation region. While still formable, a pool edge cap or sill, such as the cap 50 in FIG. 3, is pressed down, with the leg 51 immersed in the still formable concrete. Alternatively, the cap 18 is similarly applied. The cap or sill may be formed of a length of aluminum or a length of extruded plastic having the cross-sectional configuration as indicated. This cap or sill serves to protect the top edge of the pool from excess water drainage and physical contact with the user of the pool in climbing out, diving, etc. Water drainage between the side wall and apron can lead to problems best avoided as by the cap.

Woven fiber glass cloth as hereinabove described is readily available in a variety of weights, widths and lengths. The woven cloth can, of course, be composed of a variety of weights of glass yarn of a variety of weights and twists. The selection or the particular composition of the woven fiber glass cloth is not a part of the present invention. A 10 ounce woven cloth (Stock No. 7500 obtained from Cadillac Plastics Corporation and manufactured by Johns Manville of New Jersey) has served satisfactorily in the fabrication of wall structures in accordance with the present invention.

Nonwoven mat of various widths carried on rolls in continuous lengths and formed of a thickness of nonwoven fiber glass is also available and in some cases can be substituted for the woven cloth, particularly in the forming of the bottom walls, where strength is not as important a factor as in the side walls. Nonwoven mat can be formed of chopped lengths secured in a nontacky binder or a continuous length in swirled overlapping random pattern.

Additionally, on-site corner and bottom seams can be formed of other than strips of woven cloth or mat.

Commercial equipment is available for spraying a mixture of resin and chopped lengths of fiber glass. This type of application of chopped lengths of glass and resin can also be employed on the site to reinforce critical areas and/or to mend regions perhaps damaged in transit.

The particular polyester resin is not in and of itself a part of the present invention in terms of variation of formulation. A large variety of such resins are commercially available from such manufactures as Pittsburgh Plate Glass Company, Monsanto, Rohm & Haas, Hatco and the like. Polyester resins have proven useful in providing a desirable combination of strength, cure rate and economy as well as handleability in the prefabrication of the wall structures. A resin found eminently satisfactory is available from the Hatco Company of Swanton, Ohio under the product number JR-455.

The installation of appropriate drains, plugs, piping and recycling accessories for purposes of filtration, filling, draining, etc., have not been included in the present description since such plumbing is not a part of the present invention and is well understood by those versed in the swimming pool installation art. The walls of the present invention can be readily modified with appropriate ports or holes for insertion of the appropriate inlets or drains, requiring only a hand layup reinforcement at the site, with appropriate amounts of fiber glass cloth and resin in suitable precut sizes.

The foregoing will suggest to those skilled in the art a variety of obvious modifications and substitutions; all of which are intended to be included within the scope of the present invention unless such changes, modifications and/or substitutions would do violence to the language of the appended claims.

I claim:

1. A pool construction of the below ground level type and having a bottom wall and marginally connected, vertically upstanding linear side and end walls disposed to, in concert, define a polygonal, water-tight enclosure for the water in said pool, said side and end walls each having a lower edge defining a seam with said bottom wall and an upper edge, said side and end walls including:

a center core formed of a plurality of planar members arranged in mutual edge-to-edge aligned abutment to form the linear extent of said walls and a layer of resin-impregnated fiber glass bonded to each planar opposed surface of said wall in a manner to completely encapsulate said linear array of core panels to provide a water proof barrier and means for sealing said seams.

2. A pool construction as claimed in claim 1, wherein said walls include stiffener means extending the entire linear extent of said wall.

3. A pool construction as claimed in claim 2, wherein said stiffener means is a length of material more rigid than said core extending along the upper outer surface edge of said wall.

4. A pool construction as claimed in claim 2, wherein said stiffener means is a length of material more rigid than said core extending continuously along the bottom edge of said pool.

5. A pool construction as claimed in claim 4, wherein said stiffener means includes a length of material more rigid than said core extending along the upper outer surface edge of said wall.

6. A pool construction as claimed in claim 1, wherein said fiber glass is in the form of woven cloth.

7. A pool construction as claimed in claim 1, wherein said central core is plywood.

8. A pool construction as claimed in claim 4, wherein said length of material includes an upwardly facing linear groove and the bottom edges of said side-by-side wall panels are snugly fitted in said groove.

9. A pool construction as claimed in claim 8, wherein said stiffener means includes an integral flange extending along said wall and serving as a seat for the marginal edge of said bottom wall.

10. A pool construction as claimed in claim 3, wherein said wall includes a plurality of bolts secured in said wall and extending through said wall proximate the upper edge and through the said upper stiffener member to extend outwardly for convenient engagement or abutment in appropriate anchor means.

11. A pool construction as claimed in claim 5, wherein said fiber glass is a woven cloth.

12. A pool construction as claimed in claim 10, wherein said anchor is concrete.

* * * * *